US009386888B2

(12) United States Patent
Lyons et al.

(10) Patent No.: US 9,386,888 B2
(45) Date of Patent: Jul. 12, 2016

(54) MOLDED STACKABLE BATHTUB WITH APRON AND MOUNTING ASSEMBLY

(71) Applicant: Lyons Industries, Inc., Dowagiac, MI (US)

(72) Inventors: Lance Dale Lyons, Dowagiac, MI (US); Dale Allen Kehoe, II, Elkhart, IN (US); Paul William Emerson, Dowagiac, MI (US); Richard Alexander Xouris, Granger, IN (US); Nicolett Marie Bisnett, Dowagiac, MI (US); Jerry Ted Pruszynski, Granger, IN (US); Bruce Miller, Bristol, IN (US); Robert Tupper Franz, Toronto (CA)

(73) Assignee: Lyons Industries, Inc., Dowagiac, MI (US)

( * ) Notice: Subject to any disclaimer, the term of this patent is extended or adjusted under 35 U.S.C. 154(b) by 436 days.

(21) Appl. No.: 14/037,596

(22) Filed: Sep. 26, 2013

(65) Prior Publication Data

US 2015/0082534 A1 Mar. 26, 2015

Related U.S. Application Data

(60) Provisional application No. 61/708,079, filed on Oct. 1, 2012.

(51) Int. Cl.
*A47K 3/02* (2006.01)
*A47K 3/16* (2006.01)

(52) U.S. Cl.
CPC ... *A47K 3/02* (2013.01); *A47K 3/16* (2013.01); *A47K 3/161* (2013.01); *Y10T 29/49826* (2015.01)

(58) Field of Classification Search
CPC ..... A47K 3/02; A47K 3/16; A47K 3/161
USPC ..... 4/584, 592, 595
See application file for complete search history.

(56) References Cited

U.S. PATENT DOCUMENTS

| | | | | | |
|---|---|---|---|---|---|
| 2,117,233 | A * | 5/1938 | Clark | A47K 3/16 | 248/201 |
| 2,269,748 | A * | 1/1942 | Widman | A47K 3/02 | 4/584 |
| 4,290,154 | A * | 9/1981 | Benjamin | A47K 3/008 | 4/538 |
| 4,879,858 | A * | 11/1989 | Murdoch | A47K 3/16 | 4/584 |
| 5,261,130 | A * | 11/1993 | Kendall | A47K 3/16 | 4/593 |
| 5,946,861 | A * | 9/1999 | Krist | A47K 3/008 | 4/584 |
| 5,950,370 | A * | 9/1999 | Peck | A47K 3/008 | 4/584 |
| 7,802,324 | B2 * | 9/2010 | Layfield | A47K 3/00 | 4/541.1 |
| 2014/0259362 | A1 * | 9/2014 | Zimbric | A47K 3/161 | 4/584 |

* cited by examiner

*Primary Examiner* — J. Casimer Jacyna
(74) *Attorney, Agent, or Firm* — Faegre Baker Daniels LLP

(57) ABSTRACT

A molded bathtub and mounting assembly is provided that includes a molded bathtub having a basin, a rim attached to and extending at least partially around an upper end of the basin, and an apron attached to the rim and extending downwardly therefrom; and a mounting assembly including a mounting member and a mounting clip, and a gap located between a portion of the mounting clip and the mounting member, the gap configured to receive a lower end of the apron. Multiple bathtubs may be stacked together in an inverted position with an upper bathtub receiving the basin of a lower bathtub in a cavity of the upper bathtub defined by the basin therein.

4 Claims, 11 Drawing Sheets

MOLDED STACKABLE BATHTUB WITH APRON AND MOUNTING ASSEMBLY

This application claims the benefit of U.S. Provisional Patent Application Ser. No. 61/708,079 filed Oct. 1, 2012, the complete disclosure of which is hereby expressly incorporated by reference.

BACKGROUND OF THE INVENTION

This invention relates to a bathtub having an integrated front apron, and in particular, to a bathtub having a front apron and can be stacked in a nested arrangement for shipment, and further includes a strip and locking clip assembly for use in mounting the bathtub when installed.

Bathtubs that are molded with an integral apron front typically include apron supports or struts extending between the apron and tub to stabilize the apron. However, such apron supports prevent this design of tub from being nested or stacked for shipment. Accordingly, such bathtubs are typically packaged individually in a single carton. Although this makes it easy for a homeowner to easily purchase, pick up, deliver, and install such a bathtub, it is not convenient for a contractor working on a job site with a large number of bathtubs to install, such as in a high rise hotel. The contractor must take each individual bathtub to its location, or find some place to stack the bathtubs, and then unwrap each bathtub and dispose of the packaging. This can be very inconvenient and time inefficient.

Accordingly, it is an object of the subject invention to provide a bathtub having a front apron that can be nested and stacked for easier shipment and delivery to the job site. A further object of the invention is to reduce packaging weight and waste by shipping and delivering bathtubs in a nested stacked arrangement rather than individually wrapped. A further object of the invention is that skids of the nested and stacked bathtub can be double stacked, which in one embodiment would provide 20 bathtubs in the same footprint of five standard bathtubs on a truck. It is a further object of the invention to provide a system and components for mounting and stabilizing an apron not having supports or struts, when installing such a tub at the desired installation location.

SUMMARY OF THE INVENTION

In one embodiment of the invention, a molded bathtub and mounting assembly is provided that includes a molded bathtub having a basin, a rim attached to and extending at least partially around an upper end of the basin, and an apron attached to the rim and extending downwardly therefrom; and a mounting assembly including a mounting member and a mounting clip, and a gap located between a portion of the mounting clip and the mounting member, the gap configured to receive a lower end of the apron.

Multiple bathtubs may be stacked together in an inverted position with an upper bathtub receiving the basin of a lower bathtub in an open space or cavity of the upper bathtub defined by the basin therein. The bathtub is free of support struts extending between the apron and the basin, and further may include gussets mounted to and extending between the apron and the rim. The gussets may have a long leg and a short leg, the long leg extending substantially along the height of the apron, the gusset further including a center span extending between the legs and a notch adjacent the center span coinciding with a corner where the apron and rim meet.

The mounting member may have a generally elongated rectangular configuration with the clip having a generally L-shaped configuration. The clip may include two legs and a projection that forms a gap with the mounting member.

The projection may have a generally wedge-shaped configuration including a front slope. The mounting assembly may be assembled with at least two mounting clips, with a side edge of the mounting member located adjacent shorter legs on the clips, and a bottom side of the mounting member located adjacent longer legs of the clips. The other side edge of the mounting member may form the gap with the back side of the wedge shapes. The wedge shape projection on the clips can have a pointed front edge.

In another embodiment of the invention, a method of making molded bathtubs capable of being stored and transported in a nested stacking arrangement and method for stacking is provided comprising the steps of: providing a molded bathtub having a basin, a rim attached to and extending around at least a portion of an upper end of the basin, and an apron attached to and extending downwardly from the rim; providing a pair of gussets having a long leg attached to and extending down a significant portion of the height of the apron and short legs attached to the rims, and further including a center span section and a notch located adjacent a corner between the apron and the rim; and providing a generally open area between the apron and the basin free from supports extending therebetween.

The steps may also include inverting a first bathtub and placing the rim of the bathtub on a pallet; inverting a second bathtub and inserting the basin of the first bathtub in an open space or cavity defined by the basin of the first bathtub; inverting a third and additional bathtubs and stacking the bathtubs in an arrangement wherein the basin of each lower bathtub extends into the open space formed by the basin of the bathtub above. The steps may further include placing spacers between the rim of a lower bathtub and the rim on a bathtub above; and providing a combined pallet and shipping frame for stacking two sets of nested bathtubs. The shipping frame may include a second upper pallet on which a second set of nested bathtubs is located.

Another embodiment of the invention is a method of installing a molded bathtub having an integral apron and free from supports between the apron and basin, which comprise the steps of: providing a molded bathtub having a basin, an integral rim, and an integral apron attached along one side of the rim and extending downwardly therefrom; providing a mounting assembly having at least one gap for receiving and supporting the apron in an upright position; and installing the mounting assembly in an area where the bathtub is to be located.

The mounting assembly may include a generally elongated mounting member and at least two clips arranged with the mounting member, wherein the clips have a generally L-shaped configuration with a pair of legs and a projection extending from one of the legs that forms the gap with the mounting member. The molded bathtub is free from supports extending between the apron and the basin.

BRIEF DESCRIPTION OF THE DRAWINGS

The above-mentioned and other features and objects of this invention and the manner of obtaining them will become more apparent and the invention itself will be better understood by reference to the following description of embodiments of the present invention taken in conjunction with the accompanying drawings, wherein.

Figure 1:
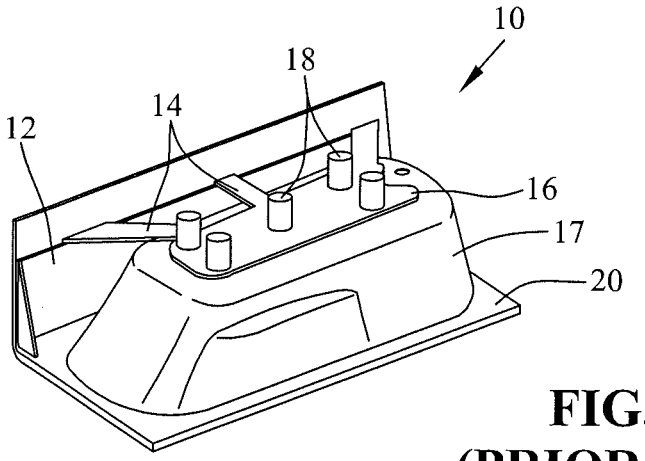
FIG. 1 (PRIOR ART)
FIG. 1 is a perspective view of a standard bathtub inverted to show apron supports that prevent nested stacking.

Corresponding reference characters indicate corresponding parts throughout the several views. Although the drawings represent embodiments of the present invention, the drawings are not necessarily to scale and certain features may be exaggerated in order to better illustrate and explain the present invention. The exemplification set out herein illustrates embodiments of the invention, and such exemplifications are not to be construed as limiting the scope of the invention in any manner.

DETAILED DESCRIPTION OF EMBODIMENTS OF THE INVENTION

For the purposes of promoting an understanding of the principles of the invention, reference will now be made to the embodiments illustrated in the drawings, which are described below. It will nevertheless be understood that no limitation of the scope of the invention is thereby intended. The invention includes any alterations and further modifications in the illustrated devices and described methods and further applications of the principles of the invention, which would normally occur to one skilled in the art to which the invention relates.

Now referring to FIG. 1, a standard molded bathtub is shown, generally indicated as 10, and in an inverted position. Bathtub 10 includes an integrally molded front apron 12 and supports or struts 14 attached to and extending between apron 12 and a bottom 16 of a basin 17 of bathtub 10. Also attached to and extending down from bottom 16 are feet 18 on which bathtub 10 stands upon when installed. Bathtub 10 also includes an upper rim or ledge 20 extending around the top thereof and to which apron 12 is attached.

As discussed above, bathtub 10 is ideal for individual packaging and sale, and struts 14 provide ample support for apron 12 when the unit is installed. However, as should be appreciated by one skilled in the art, struts 14 preclude bathtub 10 from being nested and stacked together as the rim 20 of a bathtub to be shipped over top of bathtub 10 would encounter the struts 14 on the lower bathtub and prevent stacked nesting of the tubs.

Figure 2:
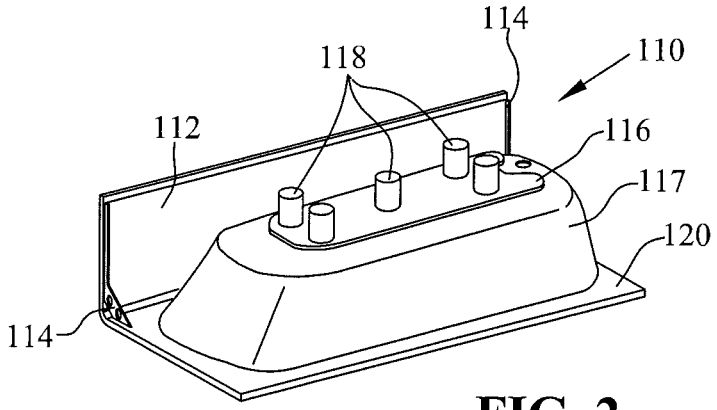
FIG. 2 is a perspective view of an inverted bathtub in accordance with the subject invention including a nested stacking design.

Now referring to FIG. 2, one embodiment of a molded bathtub in accordance with the subject invention is shown, generally indicated as 110. Bathtub 110 includes an integrally molded and attached front apron 112. However, instead of struts or supports 14 as found on bathtub 10, bathtub 110 only has end gussets 114. Also, similar to bathtub 10, bathtub 110 includes a basin 117 having a bottom 116 from which support feet 118 extend, and an upper rim or ledge 120 to which apron 112 is attached. As is shown in FIG. 2, gussets 114 extend between and are attached to apron 112 and rim 120.

Figure 3:
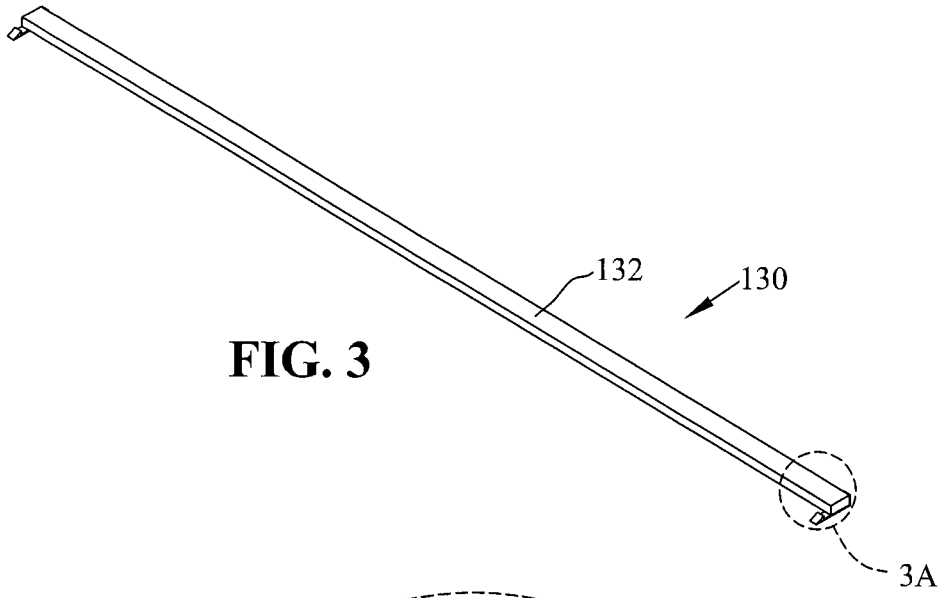
FIG. 3 is a perspective view of a mounting strip including a corner lock bracket.
Figure 3A:
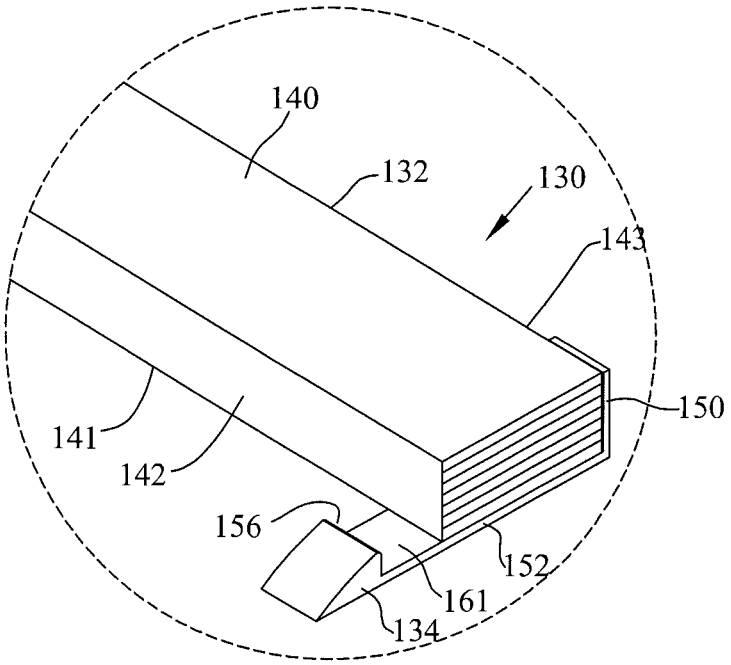
FIG. 3A is an enlarged view of the area indicated in FIG. 3 showing greater detail of the corner locking bracket attached to the mounting strip.
Figure 4:
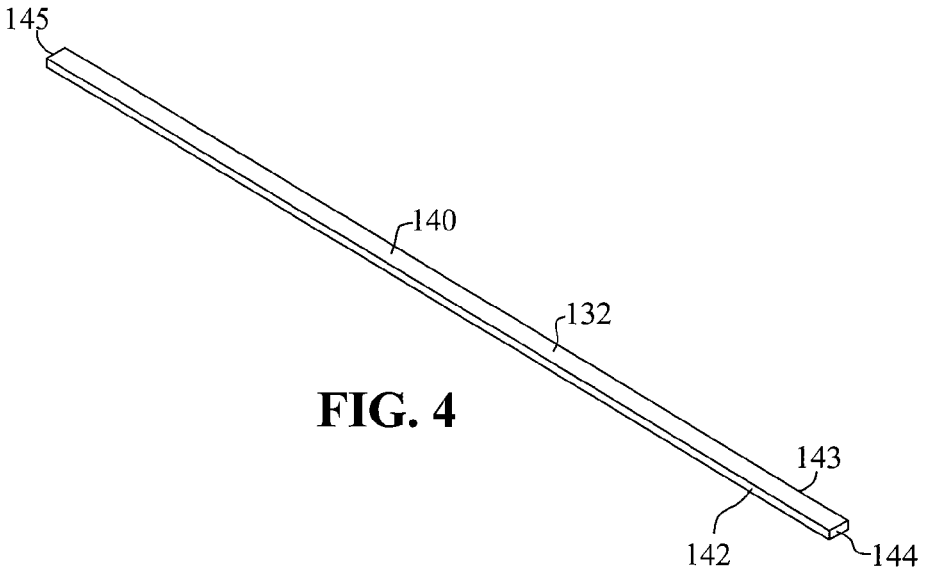
FIG. 4 is a perspective view of the mounting strip with the corner locking brackets removed.
Figure 5:
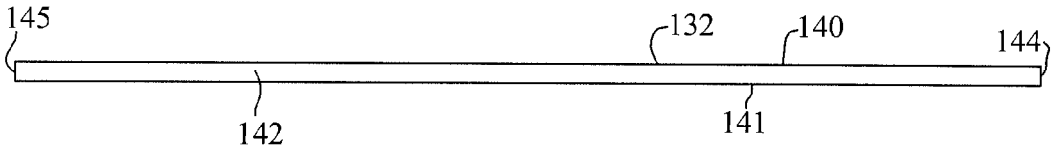
FIG. 5 is a side view of the mounting strip of FIG. 4.
Figure 6:
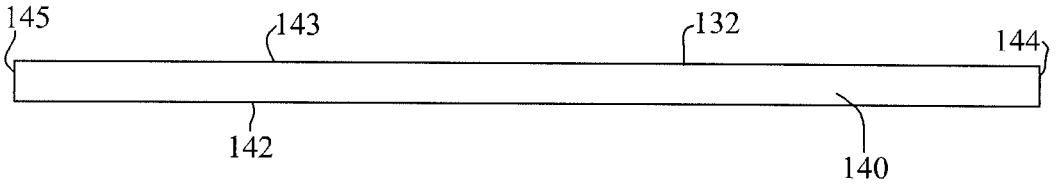
FIG. 6 is a planned view of the mounting strip of FIG. 4.
Figure 7:
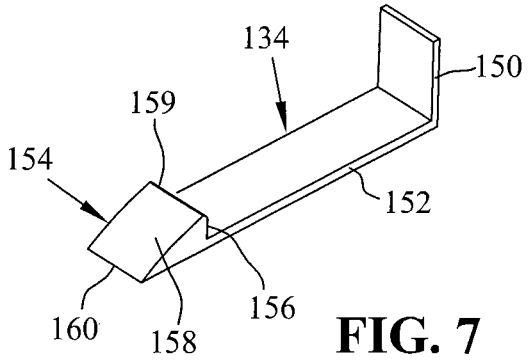
FIG. 7 is a perspective view of the corner locking bracket shown in FIGS. 3 and 3A and removed from the mounting strip.
Figure 8:
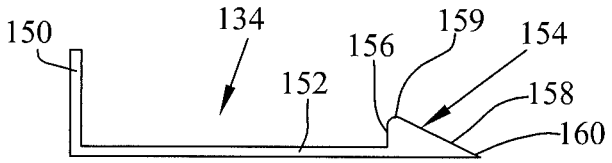
FIG. 8 is a side view of the corner locking bracket of FIG. 7.
Figure 10:
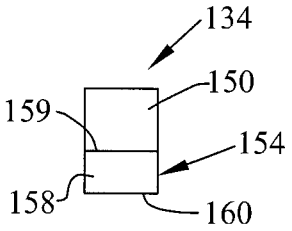
FIG. 10 is an end view of the corner locking bracket of FIG. 7.
Figure 9:
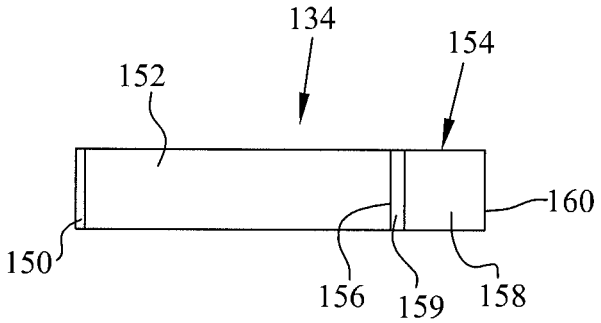
FIG. 9 is a top planned view of the corner locking bracket of FIG. 7.

Now referring to FIGS. 3 and 3A, a mounting assembly used in installing bathtub 110 is shown, generally indicated as 130. Mounting assembly 130 includes a furring or mounting strip 132 and a clip or bracket 134. As shown in FIGS. 4-6, furring strip 132 has a generally rectangular configuration including a top side 140, a bottom side 141, side edges 142 and 143, and ends 144 and 145. In the embodiment shown, furring strip 132 does not include any holes or irregularities; however, it should be realized that mounting holes may be used to mount clip 134 or recesses added to make flush mounting of clip 134. Furring strip 132 may be made from plywood or a laminated wood material, or alternately, a metal, such as aluminum or stainless, or a suitable plastic, may be used for the furring strip.

Details of clip 134 are shown in FIGS. 7-10. In the embodiment shown, clip 134 has a generally L-shaped configuration including a shorter upstanding leg 150 and longer lower leg 152 having a generally wedge-shaped configuration 154 on the end thereof. Wedge shape 154 includes a back side 156, a front slope 158, a radius 159 between back side 156 and front slope 158, and a pointed front end 160. Clip 134 may be manufactured from an ABS plastic and adhered to furring strip 132, or alternately, may be attached with fasteners or other well known attachment means. In addition, clip 134 may be manufactured from other materials, such as aluminum or stainless steel.

Clips 134 are attached or otherwise assembled with furring strips 132 as shown in FIG. 3A. The bottom side 141 of the furring strip is placed on top of bottom leg 152 of clip 134, and side edge 143 (or alternately side edge 142) is placed against leg 150 of clip 134 as shown. This creates a gap 161 between back side 156 of the wedge shape 154 of clip 134 and the front side edge 142 of furring strip 132. Gap 161 is for receipt of the bottom end of apron 112 when installed at a site as discussed in further detail below.

Figure 11:
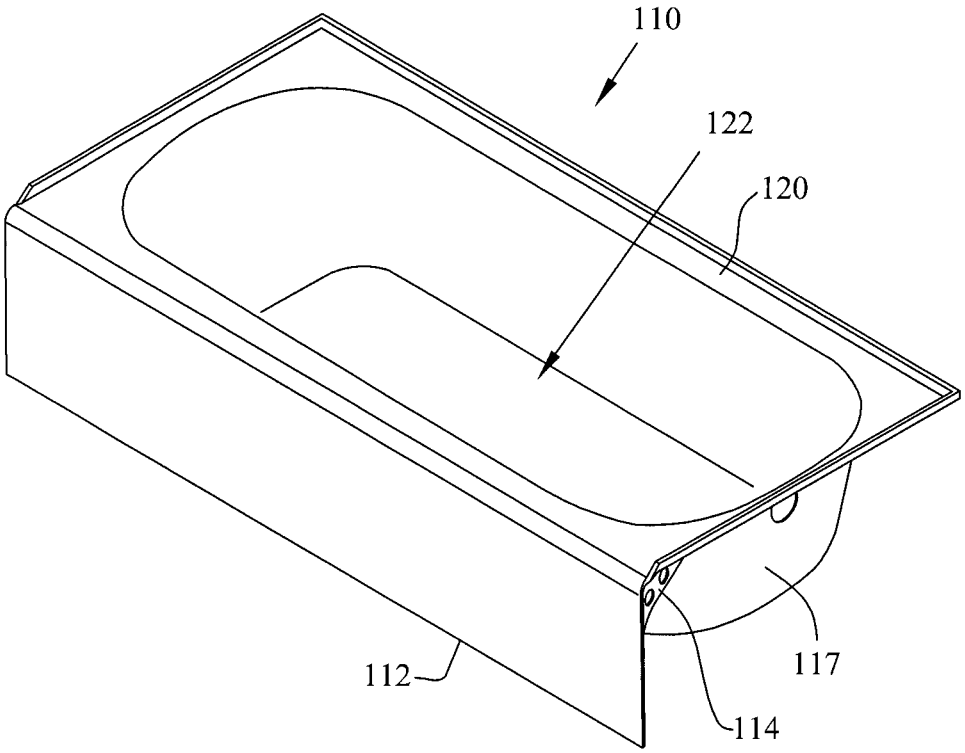
FIG. 11 is an upright view of the bathtub.
Figure 12:
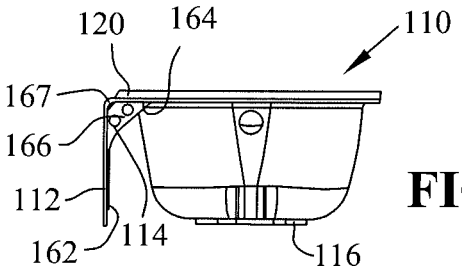
FIG. 12 is an end view of the bathtub of FIG. 11 showing the configuration of the apron support gusset.

Now referring to FIGS. 11 and 12, bathtub 110 is shown in an upright position wherein it can be seen that basin 117 defines an open space or cavity 122 for holding water for bathing. In addition, further detail of gussets 114 is shown in FIGS. 11-14. Gussets 114 include a long leg 162 attached to apron 112 and a short leg 164 attached to rim 120. Gusset 114 also includes a center span 166 having a notch 167 where apron 112 and rim 120 meet. Gusset 114 may be manufactured from an ABS plastic or corrosion-resistant metal, such as aluminum or stainless steel.

Figure 13:
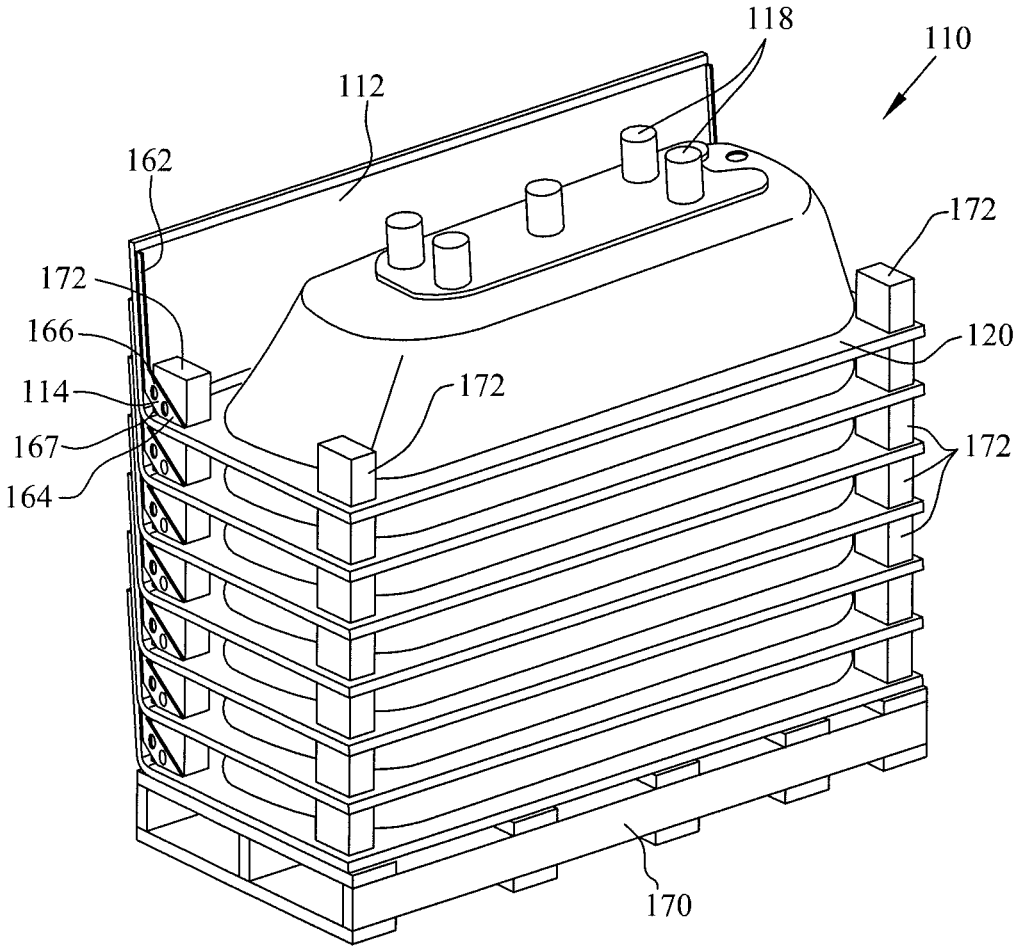
FIG. 13 is a perspective view of a series of nested and stacked bathtubs in accordance with the present invention.
Figure 14:
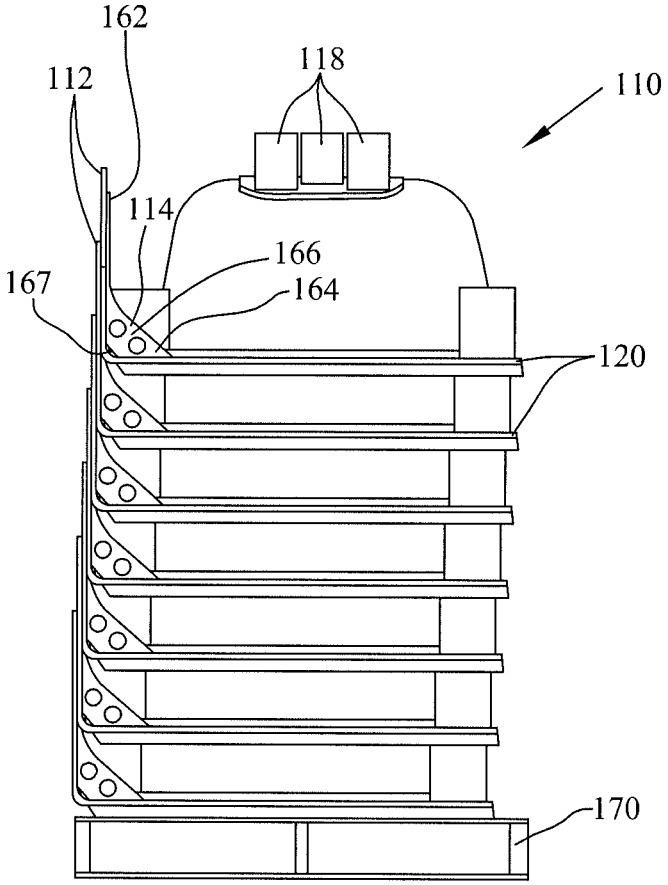
FIG. 14 is an end view of the stacked bathtubs in FIG. 13.

Now referring to FIGS. 13 and 14, an arrangement showing seven bathtubs 110 nested and stacked on a pallet 170 is shown. As can be seen, the bathtubs 110 stack quite nicely and shipping spacers 172 are provided in each corner attached to or placed on the bottom side of rim 120 so that the rim 120 on the adjacent bathtub can rest thereon and also prevent rim 120 from encountering gussets 114. Shipping spacers 172 may be manufactured from a corrugated cardboard or plastic material or alternately, hard foam, wood, or other suitable material may be used.

Figure 15:
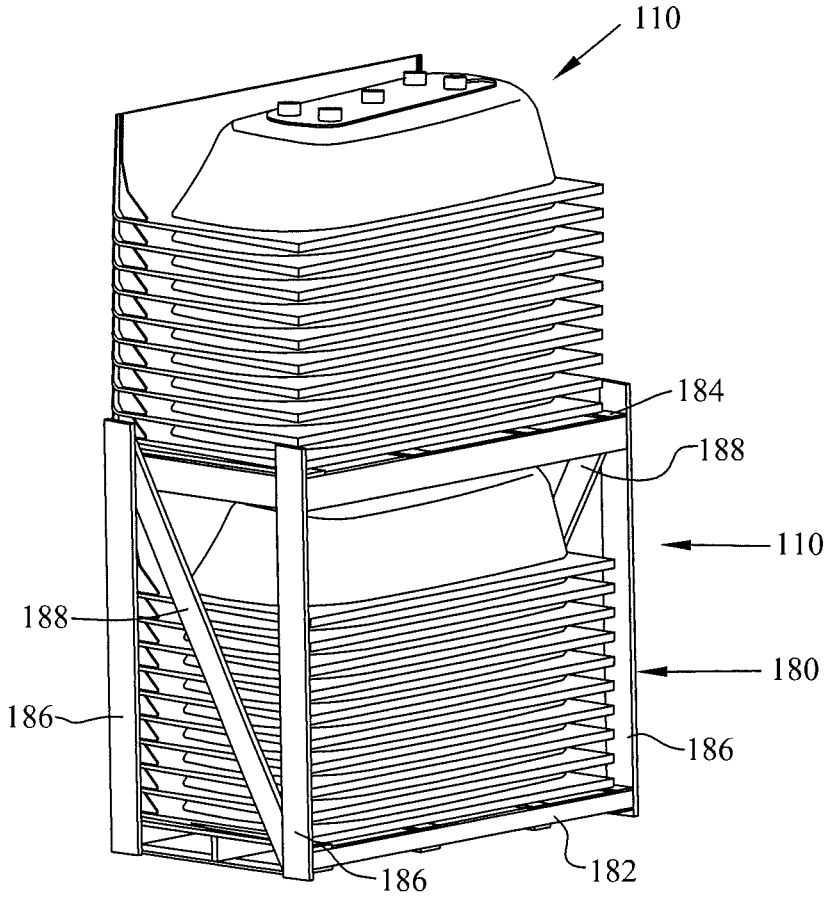
FIG. 15 is a perspective view of two sets of stacked bathtubs stacked one upon the other.
Figure 16:
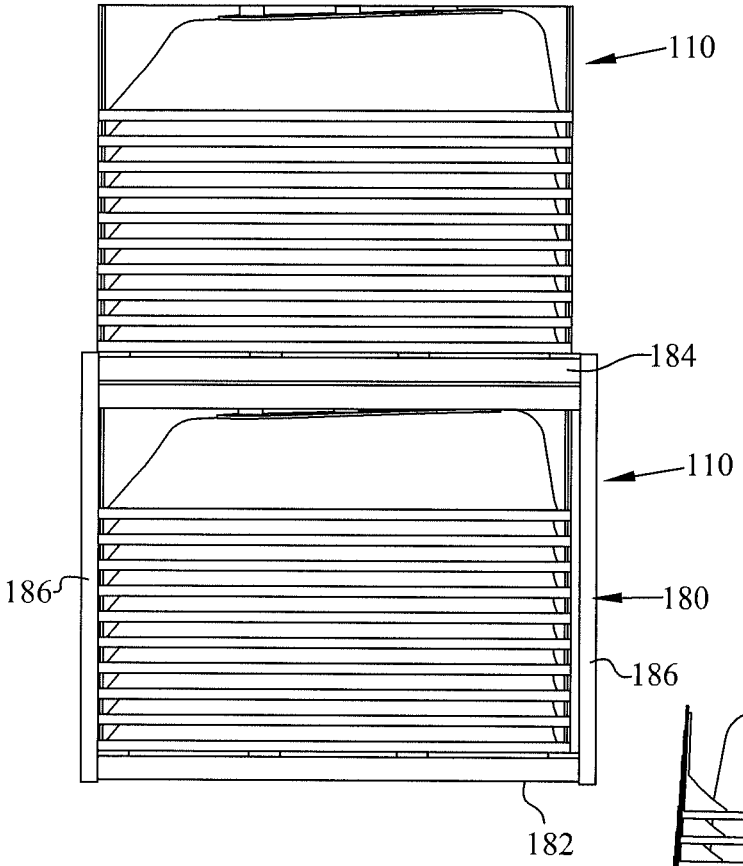
FIG. 16 is a side view of the two sets of nested and stacked bathtubs of FIG. 15.
Figure 17:
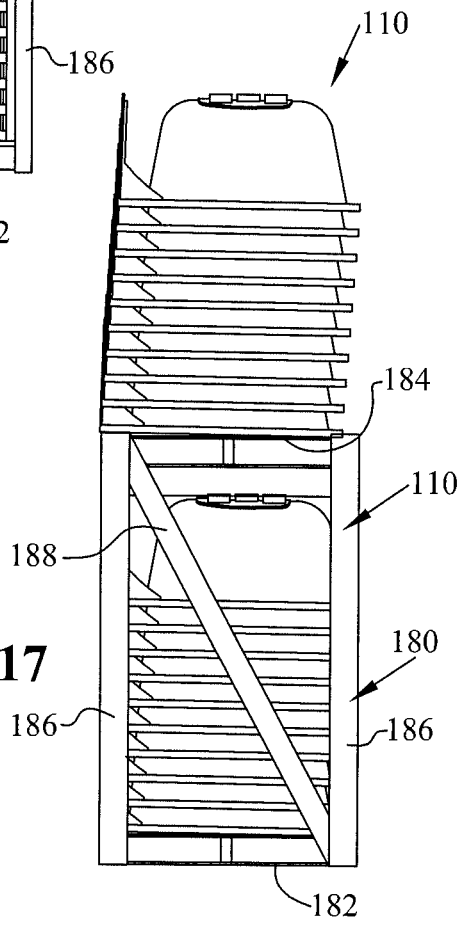
FIG. 17 is an end view of the two sets of nested and stacked bathtubs of FIG. 16.

Now referring to FIGS. 15-17, bathtubs 110 are shown nested and stacked in a double stacking arrangement of two sets of nested and stacked bathtubs. With this arrangement, 20 bathtubs can be stacked on a truck in the same footprint of five standard bathtubs. As an example, the present arrangement may allow a total of 600 nested and stacked bathtubs on a truck compared to 150 standard bathtubs. The bottom set of 10 nested and stacked bathtubs 110 are contained within a combined pallet and shipping frame 180. Pallet and shipping frame 180 includes a lower pallet portion 182 similar to pallet 170 and an upper pallet portion 184, which is also similar to pallet 170. As is shown, the lower set of nested stacking bathtubs 110 rests on lower pallet portion 182, and the upper set of nested stacking bathtubs 110 sits on upper pallet portion 184. Extending between lower pallet portion 182 and upper pallet portion 184 are a number of vertical frame members 186. More or less vertical frame members may be used as desired. Pallet and shipping frame 180 also includes angled frame members 188 to increase the stability thereof. The number, position, and orientation of angled frame members 188 may be varied as desired.

Figure 21:
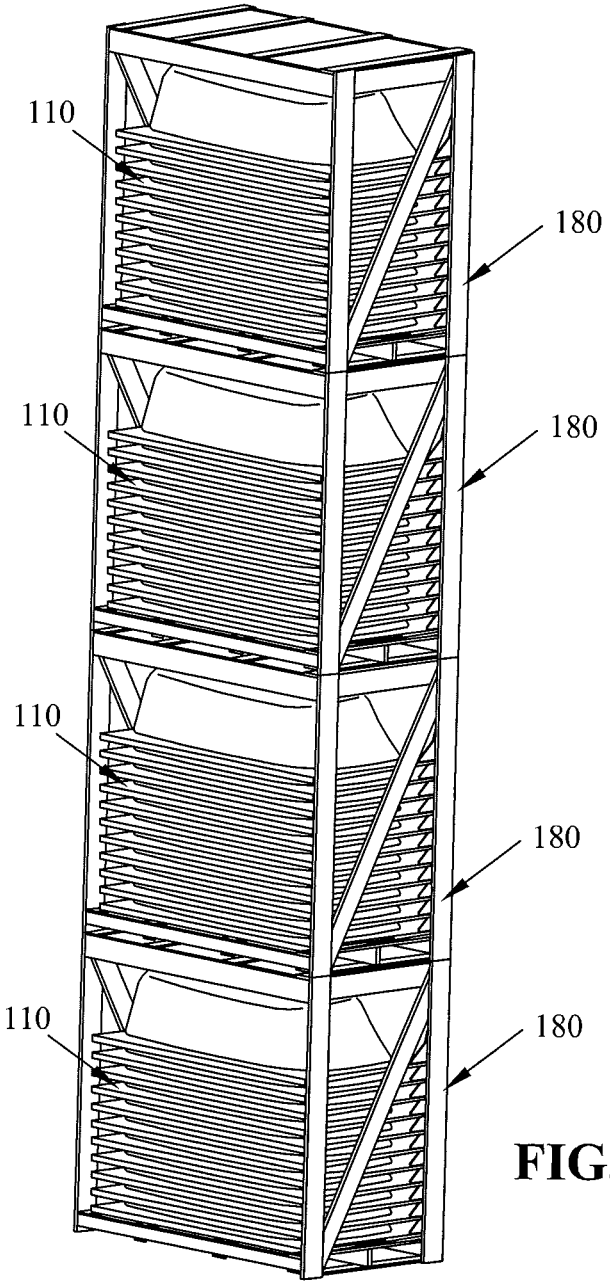
FIG. 21 is a perspective view of four sets of stacked bathtubs stacked one upon the other.

Now referring to FIG. 21, bathtubs 110 are shown nested and stacked in a stacking arrangement of four sets of nested and stacked bathtubs 110. In the example shown, each set includes seven nested bathtubs stacked together for a total of twenty-eight bathtubs being stacked one upon the other. The bathtubs 110 in FIG. 21 are shown stacked in the same combined pallet and shipping frames 180 as shown in FIGS. 15-17. Such an arrangement allows for very efficient stacking of bathtubs in a warehouse, ship, etc.

Figure 18:
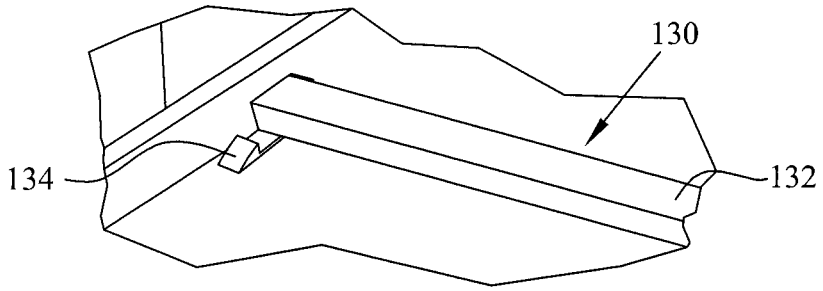
FIG. 18 is a perspective view of the mounting strip and corner locking brackets installed on site for installation of the bathtub.
Figure 19:
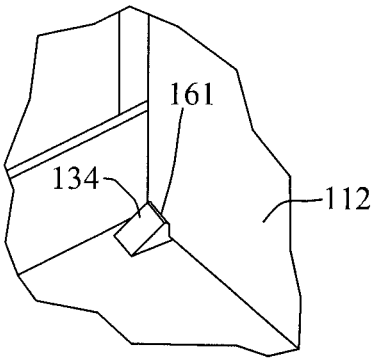
FIG. 19 is a perspective view of the bathtub and is mounted to the mounting strip and corner locking bracket.
Figure 20:
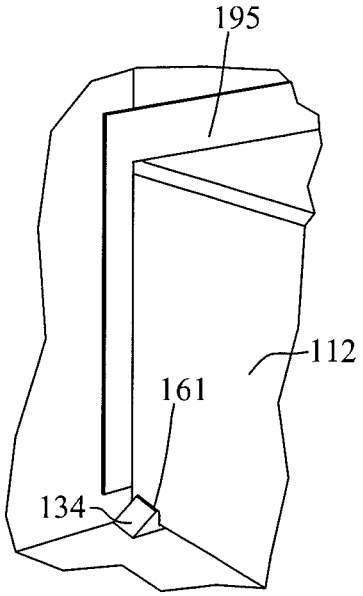
FIG. 20 is a perspective view showing verification of squareness of the installation of FIG. 19.

Now referring to FIGS. 18-20, installation of bathtubs 110 and use of mounting assemblies 130 is shown. As shown in FIG. 18, the mounting assembly is mounted to the floor with side edge 143 of furring strip 132 facing towards the back wall and clip 134 facing outwardly. Mounting assembly 130 may be nailed, screwed or attached with an adhesive. Mounting strip 130 is used to provide additional support to the apron since struts 14 have been removed to facilitate the nested stacking. Before mounting assembly 130, it is preferable to mark the subfloor based upon the dimensions of the bathtub to be installed. The front line of furring strip 132 may be marked on the subfloor, and the furring strip secured firmly behind the line. The bathtub is installed in accordance with instructions with the bottom of apron 112 positioned in gaps 161 of mounting assembly 130. (See FIG. 19.) Apron corners should be guided into the gap and once installed therein, the installation should be checked with a square 195 to verify that the apron is set all the way in at 90°. (See FIG. 20.) If the apron is not at 90°, then the bathtub should be removed, and the location of the furring strip should be moved forward or backward accordingly. Thusly installed, the mounting assembly holds the apron straight and securely during use thereof.

While the invention has been taught with specific reference to these embodiments, one skilled in the art will recognize that changes can be made in form and detail without departing from the spirit and scope of the invention. The described embodiments are to be considered, therefore, in all respects only as illustrative and not restrictive. As such, the scope of the invention is indicated by the following claims rather than by the description.

The invention claimed is:

1. A molded bathtub and mounting assembly comprising:

a molded bathtub having a basin, a rim attached to and extending at least partially around an upper end of the basin, and an apron attached to the rim and extending downwardly therefrom wherein multiple bathtubs may be stacked together in an inverted position with an upper bathtub receiving the basin of a lower bathtub in a cavity of the upper bathtub defined by the basin therein, and the bathtub is free of support struts extending between the apron and the basin, said bathtub further including gussets mounted to and extending between the apron and the rim, the gussets having a long leg and a short leg, the long leg extending substantially along the height of the apron, the gusset further including a center span extending between the legs and a notch adjacent the center span coinciding with a corner where the apron and rim meet; and a mounting assembly including a mounting member and a mounting clip, and a gap located between a portion of the mounting clip and the mounting member, the gap configured to receive a lower end of the apron.

2. A molded bathtub and mounting assembly comprising:

a molded bathtub having a basin, a rim attached to and extending at least partially around an upper end of the basin, and an apron attached to the rim and extending downwardly therefrom; and a mounting assembly including a mounting member and a mounting clip, and a gap located between a portion of the mounting clip and the mounting member, the gap configured to receive a lower end of the apron, the mounting member having a generally elongated rectangular configuration, and the clip having a generally L shaped configuration, the clip including two legs and a projection that forms a gap with the mounting member, the projection having a generally wedge-shaped configuration including a front slope and wherein the mounting assembly is assembled with at least two mounting clips, and a side edge of the mounting member is located adjacent shorter legs on the clips, and a bottom side of the mounting member is located adjacent longer legs of the clips.

3. The bathtub and mounting assembly as set forth in claim 2, wherein the other side edge of the mounting member defines the gap with a back side of the wedge shapes.

4. The bathtub and mounting assembly as set forth in claim 3, wherein the wedge shape projection on the clips have a pointed front edge.

* * * * *